US005784471A

United States Patent [19]

Bebenroth

[11] Patent Number: 5,784,471

[45] Date of Patent: Jul. 21, 1998

[54] HEARING AID WITH AN ELECTRODYNAMIC ACOUSTIC TRANSDUCER

[75] Inventor: Wolf-Dietrich Bebenroth, Gross Hehlen, Germany

[73] Assignee: Sennheiser electronic GmbH & Co. KG, Wedemark, Germany

[21] Appl. No.: 678,333

[22] Filed: Jul. 11, 1996

[30] Foreign Application Priority Data

Jul. 15, 1995 [DE] Germany ..... 195 25 865.7

[51] Int. Cl.[6] ..... H04R 25/00

[52] U.S. Cl. ..... 381/69; 381/68.6; 381/69.2

[58] Field of Search ..... 381/68.6, 69, 68, 381/25, 68.2, 68.3, 68.4, 68.5, 68.7, 69.2, 183, 187; 181/129, 130, 135

[56] References Cited

U.S. PATENT DOCUMENTS

| | | | |
|---|---|---|---|
| 2,430,229 | 11/1947 | Kelsey | 381/68.6 |
| 3,197,576 | 7/1965 | Martin | 381/68.6 |
| 3,408,461 | 10/1968 | Langford | 381/69 |
| 3,983,336 | 9/1976 | Malek et al. | 381/68.6 |
| 4,553,627 | 11/1985 | Gastmeier | 381/68.6 |

FOREIGN PATENT DOCUMENTS 4329982 3/1995 Germany .

*Primary Examiner*—Huyen Le
*Attorney, Agent, or Firm*—McAulay Fisher Nissen Goldberg & Kiel, LLP

[57] ABSTRACT

The invention is directed to a hearing aid with an electrodynamic acoustic transducer. Such hearing aids were previously produced by otoplastic techniques. A novel acoustic transducer which departs from the construction principle previously employed for construction of the acoustic transducer is known from the German Application P 43 29 892.2. The object of the present invention is to provide a solution for the practical use of the edged acoustic transducer in a hearing aid and to simplify the production of a hearing aid. This object is met according to the invention by a hearing aid in which the housing of the hearing aid has a movably supported ear tube in which sound waves generated by the electrodynamic acoustic transducer can be transmitted through the interior of the ear tube. As a result of the invention, the manufacture of a hearing aid is substantially simplified and manufacturing costs are dramatically reduced.

3 Claims, 4 Drawing Sheets

HEARING AID WITH AN ELECTRODYNAMIC ACOUSTIC TRANSDUCER

BACKGROUND OF THE INVENTION a) Field of the Invention

The invention is directed to a hearing aid with an electrodynamic acoustic transducer, e.g., of the type known from German Patent Application P 43 29 892.2. The object of the invention according to this reference was to develop an acoustic transducer of the type indicated in the prior art which had the smallest possible dimensions while fulfilling the seemingly conflicting demands for high sensitivity with high impedance and a large transmission bandwidth.

b) Description of the Related Art

The invention according to P 43 29 892.2 departed from the construction principle employed in the prior art up to that point in which the annular part of the diaphragm was always arranged radially outside the central part. The annular part is therefore arranged axially below the central part and accordingly extends radially inward as viewed from the coil seat. Thus, the two diaphragm parts do not lie adjacent to one another radially, as was the case in the prior art, but rather axially one above the other.

Accordingly, it is possible to design either transducers with smaller dimensions or electric coils with larger dimensions than those previously used. In the latter case, as a result, transducers with a greater sensitivity can also be employed. The acoustic transducer arrangement described in the application cited above also enables the acoustic transducer to be constructed with dimensions enabling "in-the-ear" hearing with relatively good reproduction quality.

OBJECT AND SUMMARY OF THE INVENTION

The primary object of the present invention is to design a hearing aid of the type mentioned above which is simple to manufacture, can be adapted to the individual user, and possesses good reproduction quality.

The present invention proposes a hearing aid with an electrodynamic acoustic transducer in which the hearing aid has a housing with a movably supported ear tube and sound waves generated by the diaphragm of the electrodynamic acoustic transducer can be transmitted through the interior of the ear tube. Advantageous further developments of the invention are described below. The acoustic transducer itself is preferably constructed according to the principle described in P 43 29 892.2. However, other dynamic transducers can also be used in principle.

The present invention provides a hearing aid which can be mass produced, but which has an ear tube which can be adapted to the individual auditory canal. The ear tube is the region of the hearing aid which can be inserted into the auditory canal of the human ear. At the same time, due to the excellent quality of the acoustic transducer, outstanding sound reproduction is possible. The difference in quality between a hearing aid according to the present invention and previous hearing aids is evident particularly in the transmission bandwidth, because reasonable hearing amplification is achieved in previous hearing aids only within a narrow band region, whereas the hearing aid according to the present invention achieves good reproduction quality over most of the audible frequency band. Accordingly, comprehension is increased appreciably and the occurrence of a strong level only in a small frequency range is prevented. Further, sound reproduction has greater fidelity for the user.

Whereas it was previously necessary to fabricate an otoplastic model of the auditory canal in order to adapt a hearing aid to the human auditory canal, such otoplastic work can be completely dispensed with in the hearing aid according to the invention because the ear tube can be adjusted to the individual shape of the auditory canal due to its movability.

Costs for a hearing aid according to the invention are drastically reduced compared with previous solutions, namely by more than 50%. The solution according to the invention also allows users to adapt the hearing aid to their ears by themselves and facilitates this. Finally, the invention accordingly also allows the hearing aid to be used by those for whom a specially fabricated otoplastic device was previously unavailable.

In order to adapt the ear tube to the human auditory canal it has proven sufficient generally that the ear tube is positioned diagonally to a principal axis of the hearing aid housing or of the acoustic transducer and supported so as to be rotatable about the principal axis. If the rotatable support is self-locking, the ear tube is adequately secured automatically.

The portion of the ear tube which can be inserted into the human auditory canal itself preferably has a hollow cylindrical shape which has at least one annular circumferential projection on the outside for holding a filling medium, e.g., in the form of foam, which preferably has sound-absorbing properties. The interior of the hollow cylindrical portion forms the sound transmission space of the ear tube, while the sound-absorbing medium can be arranged between the outer side of the ear tube and the inner wall of the auditory canal so as to prevent sound from passing through this gap. Further, the filling medium improves the fit of the hearing aid in the human ear. Thus, while the movable ear tube allows a rough adjustment to the shape of the human auditory canal, the filling medium which is inserted into the auditory canal provides for precise adjustment and at the same time prevents sound from passing through the gap between the ear tube and the inner auditory canal.

For the purpose of the rotatable support of the ear tube, this ear tube has a region which partially encloses the acoustic transducer and whose inner side is provided with an annular circumferential projection which is supported in turn in an annular circumferential groove of the hearing aid housing. Accordingly, a sturdy connection of the ear tube body with the hearing aid housing is produced and the rotation of the ear tube about the rotational axis which coincides with the principal axis of the acoustic transducer is enabled at the same time. Further, the connection enables a self-locking continuous rotation of the ear tube so that the ear tube can assume any desired adjustment angle. Of course, it is also possible for the ear tube to be movably supported along multiple axes, e.g., by means of a ball joint bearing or ball socket bearing. The degrees of freedom of movement of the ear tube are increased by means of a multiple-axis support, resulting in improved adaptability to the human auditory canal.

The microphone of the hearing aid is accommodated inside a housing part which is located at a relatively great distance from the acoustic transducer. Accordingly, it is possible to provide one or more intermediate walls between the acoustic transducer and the microphone so as to achieve a complete decoupling of the sound outlet of the acoustic transducer and the sound inlet of the microphone so that unwanted feedback effects are precluded from the start. Accordingly, it is also possible to use medium-quality components for processing and picking up the acoustic signals, while at the same time allowing a sufficiently loud amplification of the acoustic signals to be adjusted.

The hearing aid has a regulator which is freely accessible to the user for individual loudness adjustment and which allows the user to adjust the desired loudness by changing the state of an amplifier circuit.

The manufacture of the hearing aid according to the invention is sufficiently simplified in that the housing is formed essentially from two connectable parts. The housing part remote of the ear can be provided with a decorative cap which is connected with the housing by means of a snap connection so as to be exchangeable. Such a decorative cap can be provided with a fashionable design so that the hearing aid not only fulfills its functional purpose in alleviating hearing loss, but also serves as a fashion accessory so that reluctance to wearing a hearing aid is further reduced.

The portion of the ear tube located in the auditory canal is advisably filled within the sound transmission space at least partially, if not completely, with a sound-transmitting medium, e.g., foam, which allows the sound to pass through without attenuation, but at the same time prevents the penetration of impurities, especially cerumen. Since cerumen is a relatively aggressive medium which can damage sensitive electrical and electromechanical parts in the hearing aid, particularly the acoustic transducer, merely through contact, the use of the sound-transmitting medium as a protective shield against the penetration of substances is very advantageous. Once the sound-transmitting medium itself is soiled, it can be exchanged in a simple manner by removing it from the interior of the ear tube and replacing it with new medium. A relatively coarse foam has proven advisable as a medium.

The invention will be explained more fully in the following with reference to an embodiment example.

DESCRIPTION OF THE PREFERRED EMBODIMENTS

Figure 1:
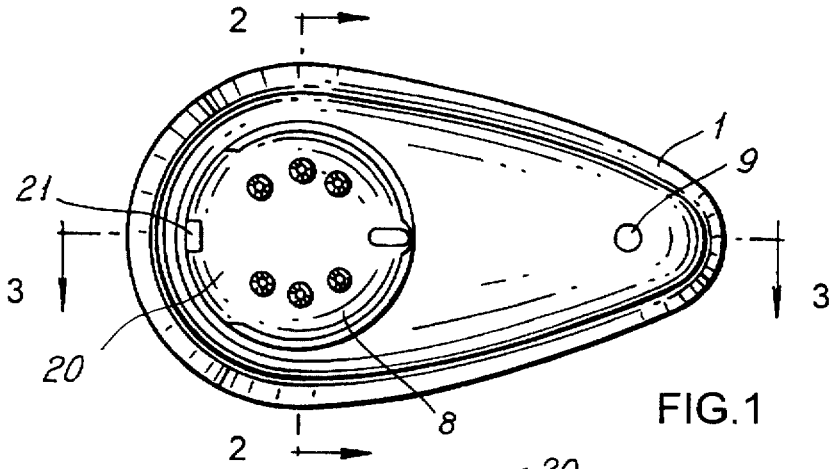
FIG. 1 shows a plan view of a hearing aid according to the invention in a scale of approximately 3:1.

FIG. 1 shows a plan view of the front side of a hearing aid 1 with a loudness regulator 8 and a sound inlet opening 9 for a microphone 16 which is arranged behind the latter. The loudness regulator 8 is an adjusting wheel which is supported in the housing 5 of the hearing aid 1 so as to be rotatable. The loudness of the sound reproduction of the hearing aid 1 can be adjusted by means of this loudness regulator 8. In addition to its function as adjusting element, the loudness regulator is designed as a flap 20 which can be folded up via a hinge 21 so that a battery 22*a* can be placed in a battery compartment located under the flap.

Figure 4B:
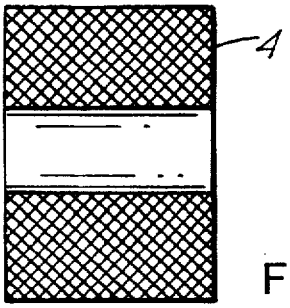
FIG. 4*b* shows a cross section through a filling foam.
Figure 2:
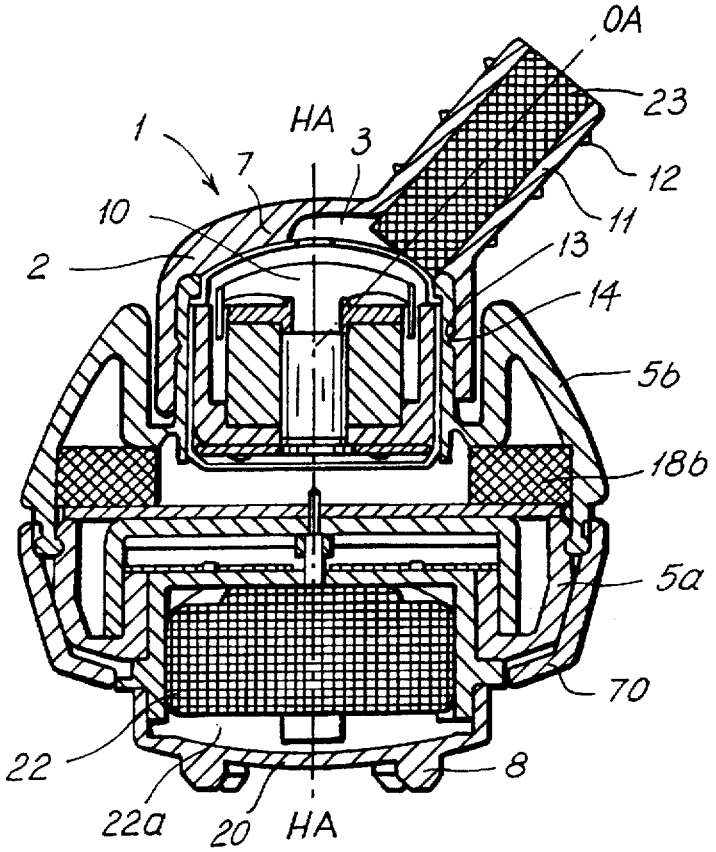
FIG. 2 shows a cross section through the hearing aid according to the invention along line A—A in FIG. 1.
Figure 6:
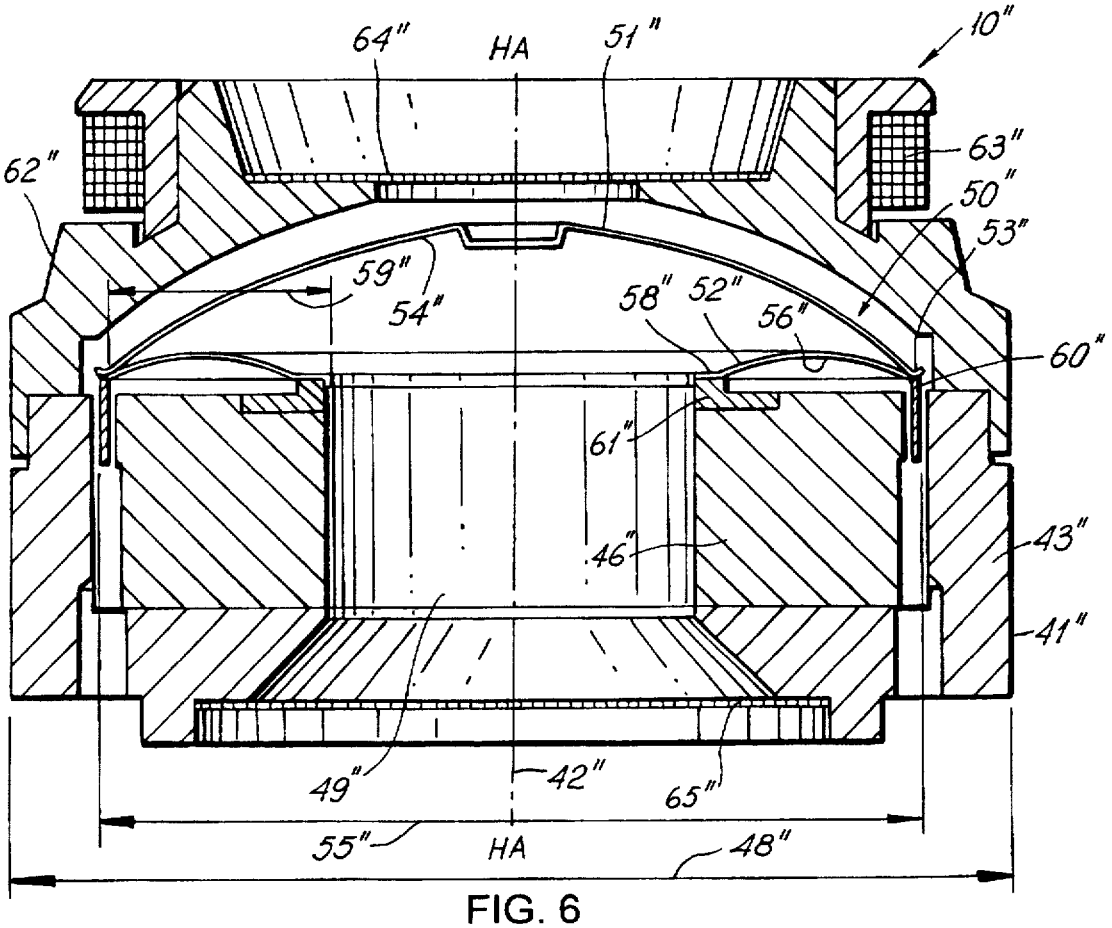
FIG. 6 shows an axial section through an electrodynamic transducer of the hearing aid.
Figure 7:
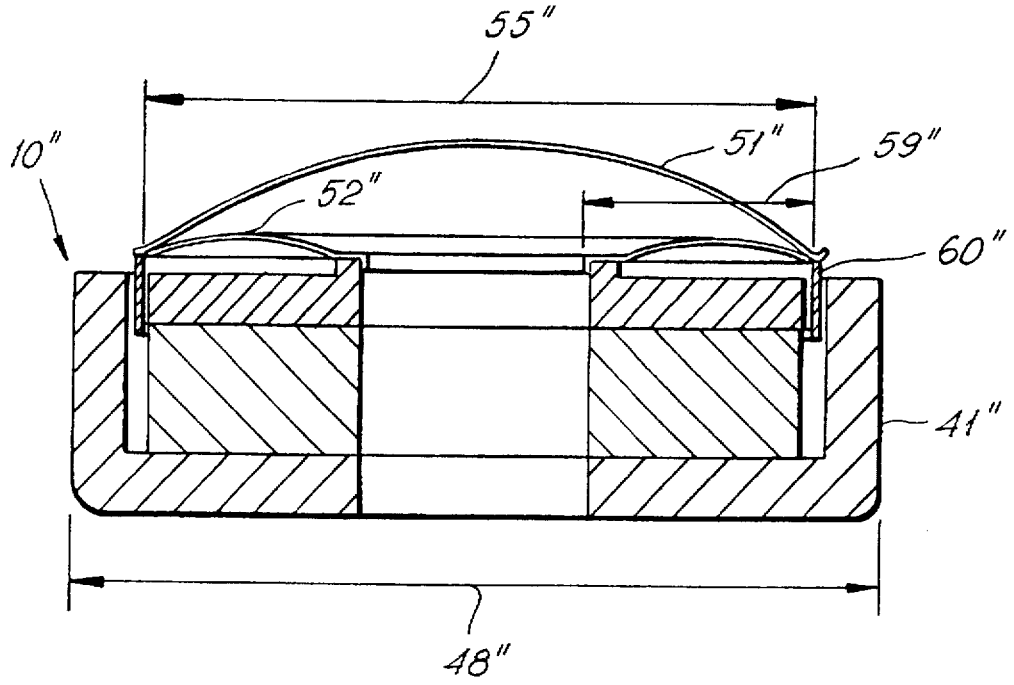
FIG. 7 shows another view of an acoustic transducer known from P 43 29 982.2.

FIG. 2 shows a section along line A—A through the hearing aid shown in FIG. 1. The housing 5 of the hearing aid 1 is formed substantially of two parts Sa and 5*b* which are held together by means of a screw connection shown in FIG. 3 by screws 19. One part 5*a* forms the portion of the housing remote of the ear and receives the loudness regulator 8 and battery. The acoustic transducer 10, whose construction will be explained in detail hereinafter with reference to FIGS. 6 and 7, is accommodated in the other part 5*b* which faces the human ear. Further, part 5*b* has an ear tube body 7 or ear tube 2 with another part which has an acoustic canal 3 and which is constructed as a projecting continuation 11 and can be inserted into the auditory canal of the human ear. In FIG. 2, the projecting continuation 11 of the ear tube 7 is constructed as a hollow cylinder so as to form the acoustic canal 3 within its interior. However, the acoustic canal 3 or continuation 11 can also be shaped differently. On its outer side, the continuation 11 of the ear tube 7 has circumferential projections 12 or rings which can hold a filling medium 4 shown in FIG. 4*b*. The filling medium 4 is a foam and serves to acoustically seal the space between the ear tube continuation 11 and the inner wall of the auditory canal so that the transducer acts roughly as a pressure chamber. In order to protect the interior 3 of the ear tube 2, the hollow cylindrical continuation 11 receives a sound-transmitting protective foam 23 which prevents the penetration of substances such as cerumen into the hearing aid 1.

The ear tube 7 is supported so as to be rotatable about a principal axis HA of the hearing aid 1 in that a part 13 of the ear tube 7 projecting into the hearing aid has, at its inner side, an annular projection 14 which cooperates with an annular circumferential groove 13 of a corresponding complementary part of the housing part 5*b*. The annular projection 14 and the annular circumferential groove 13 enable a self-locking rotation of the ear tube about the principal axis HA while also producing an adequate fastening of the ear tube at the housing part 5*b*. Further, the encircling construction of the ear tube around the region of the acoustic transducer 10 enables optimal sound transmission from the acoustic transducer 10 via the acoustic canal 3. The center axis OS of the continuation 11 of the ear tube is adjusted at approximately 45° to the principal axis HA.

Figure 3:
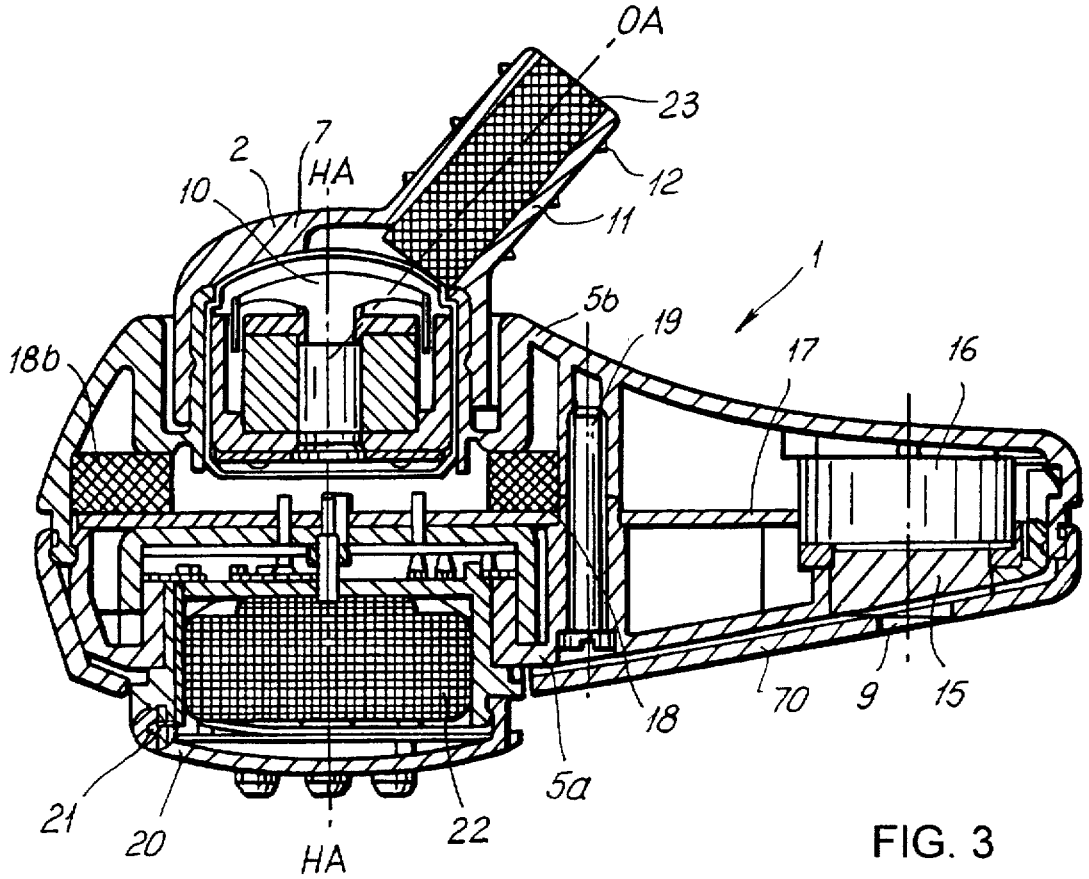
FIG. 3 shows a cross section through the hearing aid according to the invention along line B—B in FIG. 1.

FIG. 3 shows the hearing aid shown in FIG. 2 in cross section along line B—B as in FIG. 1. It will be seen from FIG. 3 that the microphone 16 is relatively far away, i.e., roughly 0.8 to 1.5 cm, from the acoustic transducer 10 and is arranged immediately below the sound inlet opening 9 of the hearing aid 1. A sound-transmitting medium 15 is provided between the sound inlet opening 9 and the sound inlet opening of the microphone 16 so as to prevent the penetration of dirt and other substances but so as to allow sound to pass through without attenuation. The microphone 16 is bordered by a board 17 on which are arranged the signal processing and sound amplifying components for the sound signals sent by the microphone.

Screws 19 are provided in the central region 18 for connecting the two housing parts 5*a* and 5*b*. Further, a sealing ring 18*b* is provided away from the center as acoustic sealing between the acoustic transducer region and the microphone region so as to improve the acoustic decoupling between the microphone 16 and the acoustic transducer 10.

Figure 5A:
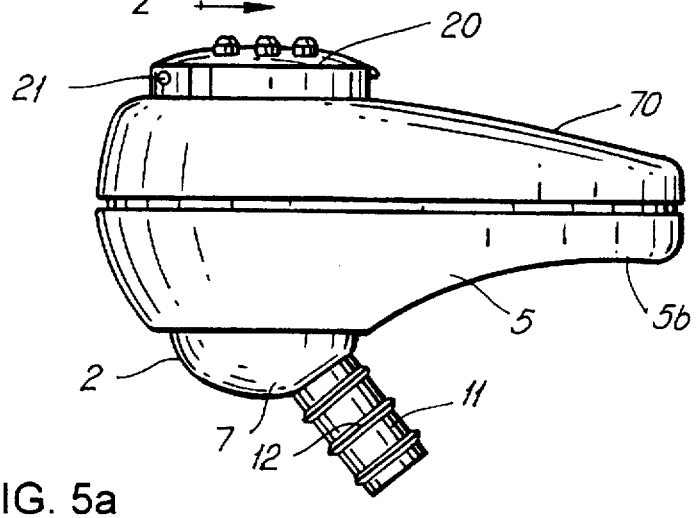
FIG. 5*a* shows a side view of the hearing aid according to the invention.
Figure 5B:
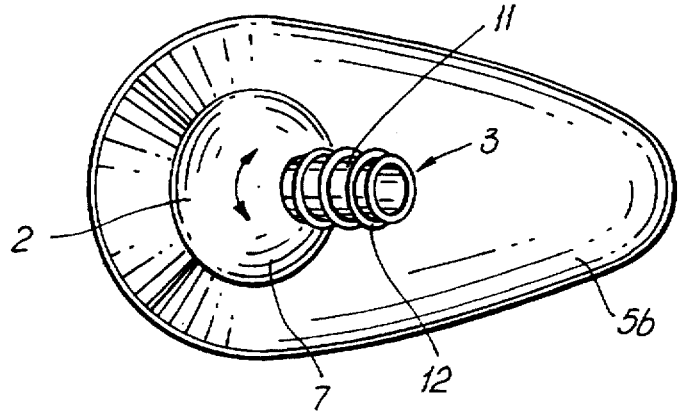
FIG. 5*b* shows a bottom view of the hearing aid according to the invention.

FIG. 5*a* shows the hearing aid according to the invention in a side view in which the shape of the circumferential projections 12 of the ear tube 11 can be seen particularly clearly.

Figure 4A:
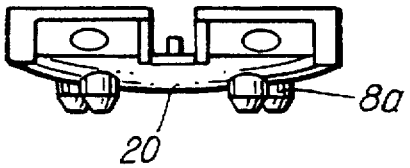
FIGS. 4*a* shows a side view of a regulator with a battery compartment receptacle.

FIG. 4*a* is another side view which shows the loudness regulator 8. The protuberances 8*a* located on the loudness regulator serve to facilitate the turning of the loudness regulator and to form a point of application for the user when adjusting the loudness.

The movable support of the ear tube allows the user to position the ear tube continuation in such a way that the ear tube fits into the auditory canal of the human ear. At the same time, the housing of the hearing aid can be brought into a position which is appropriately adapted to the external ear. The alignment of the ear tube provides for a rough adaptation to the human auditory canal. The medium 4 surrounding the ear tube continuation serves for precision adaptation. This medium 4 acoustically seals the intermediate space between the outer surface of the ear tube continuation and the inner wall of the auditory canal and has a substantial sound-absorbing characteristic such that sound cannot pass through the gap between the ear tube and the inner wall of the auditory canal.

This means that when the hearing aid is turned off by the user or when the loudness is set to zero the hearing aid serves simultaneously as a hearing protector which achieves substantial sound absorption over broad areas of the audible frequency range.

As a result of the relatively large distance between the microphone and the acoustic transducer or sound delivery through the ear tube, unwanted feedback effects which are extremely detrimental to hearing enjoyment and considerably impair the electrical circuit components are prevented from the outset. This ensures dependable use of the hearing aid independent from individual influences. It is also possible to use the hearing aid in either ear, whereas hearing aids produced by means of otoplastic techniques will fit only in one ear, but not in the other.

Figure 8:
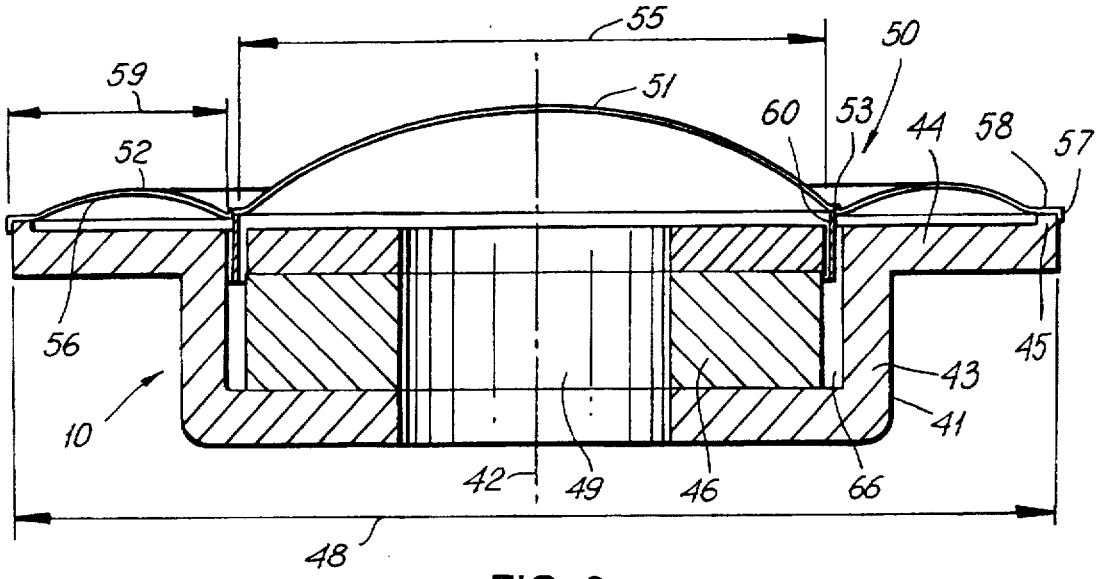
FIG. 8 PRIOR ART
FIG. 8 shows an axial section through a partial region of a transducer constructed according to principles known from the prior art.

An electrodynamic transducer 10 for use in the hearing aid is described hereinafter. A transducer 10 such as that already known from the published prior art is based on the known principle of construction shown in FIG. 8. FIG. 8 shows only the bottom portion 41 of the transducer which serves to support a diaphragm 50. The transducer 10 is constructed so as to be rotationally symmetric with reference to an axis 42, shown in dashed lines, and comprises a cup 43 which, due to the construction of the known diaphragm 50 which will be described more fully hereinafter, passes into a radial flange 44 and finally terminates in a ring insert 45. A ring magnet 46, whose inner opening forms an acoustic passage 49 which also penetrates the housing shell enclosing it, is located in the interior of the cup 43. Together with the cup 43, the outer circumference of the ring magnet 46 encloses an annular gap 66 which is penetrated by a wire coil 60 when the diaphragm 50 is mounted.

The associated diaphragm 50 can be divided essentially into two differently profiled parts 51, 52. The component part of the diaphragm 50 having the actual acoustic effect lies in the center of the diaphragm and is formed of a central part 51 with a caplike curvature 54. This central part 51 of the diaphragm 50 is conventionally referred to as the "cap". The greatest possible diameter 55 of the central part 51 is desirable for a high sensitivity of the transducer 10. At the same time, a certain rigidity of the central part 51 is advantageous for good acoustic reproduction or for acoustic reception. However, strict limits are imposed on the dimensions of the diameter 55 by the arrangement of the second annular diaphragm part 52 for reasons which will be stated hereinafter.

As will be seen from FIG. 8, the central part 51 of the known diaphragm 50 is enclosed by an annular part 52 of the diaphragm 50 which extends outward radially. The annular part 52 has an arc-shaped profile 56 whose convex side faces in the same direction as the cap curvature 54 of the central part 51 which was described above. This annular part 52 is commonly referred to as the "surround" and its function is to provide for a resilient suspension of the central part 51 in the transducer housing 51. The outer circumferential edge 57 of the known diaphragm 50 is provided with a stepped fastening edge 58 which is supported at the above-mentioned annular step 55 of the transducer housing 51.

A narrow annular zone which serves as a coil seat 53 for a coil 60 is located in the transitional area between the central part 51 and the annular part 52. One cylindrical front end of the coil 60 is securely connected with the coil seat 53. Consequently, when used as an acoustic receiver, axial movements of the central part are transmitted to the coil 60 and, conversely, when used as an acoustic transmitter, as in the hearing aid 1, axial movements executed by the coil are transmitted to the central part 51 supporting it.

To ensure the desired favorable movability of the central part 51 in its interaction with sound it is also desirable for the annular part 52 to have the largest possible dimensions. Accordingly, allowing for the aforementioned fastening edge 58 enclosing the annular zone, the annular width 59 indicated in FIG. 8 is added on to the diameter 55 of the central part 51. This results in considerable outer dimensions 48 of the transducer housing 41.

For reasons of dimensions, it is practically impossible to design a comfortable, wearable hearing aid with the transducer shown in FIG. 8 unless the hearing aid is built around the acoustic transducer by means of preliminary otoplastic work and the amplifier circuits are individually adapted to the acoustic factors associated with the given user so as to prevent burdensome feedback effects.

In the hearing aid shown in FIGS. 1 to 4, in contrast to the prior art shown in FIG. 8, an acoustic transducer such as that described in the German Application P 43 29 892.2 is used.

The acoustic transducer 10" in FIGS. 6 and 7 has a completely novel construction principle compared with the acoustic transducer shown in FIG. 8. The same reference numbers used for the transducer 10 according to FIG. 8 are used to designate corresponding component parts in FIG. 7 with the addition of a double stroke (").  Unless otherwise indicated, reference is had to the preceding description of the acoustic transducer as regards these parts.

In the diaphragm 50", the two diaphragm parts 51", 52" do not lie adjacent to one another radially, but are staggered axially as viewed in the direction of axis 42" of FIGS. 6 and 7.

Although the coil seat 53" in the diaphragm 50" is also the structural component part determining the outer boundary of the central part 51" in this case, this coil seat 53 at the same time determines the maximum outer diameter 55" of the entire diaphragm. Whereas the annular part 52 in the transducer 10 according to FIG. 8 adjoins the coil seat 53 radially at the outside, the annular part 52" in the transducer 10" according to the invention as shown in FIG. 6 extends inward radially. The annular part 52" lies with its arc profile 56" entirely in the curved region 54" of the central part 51". The fastening edge 58" of the diaphragm, which is also located at the free edge of the annular part 52" in this case, no longer determines the outermost outline of the diaphragm as it does in FIG. 8, but rather is turned radially inward. The ring width 59" occurring in the diaphragm 50" according to the invention is no longer added on to the diameter 55" of the central part as in the known transducer 10 shown in FIG. 8. This ring width 59" has no effect on the outer dimensions 58" of the lower part 41" of the transducer housing which are shown in FIG. 7.

The ring magnet 46" shown in FIG. 7 carries an annular shoulder 61", e.g., a ring which is recessed into the ring magnet 46" and which serves as a support for the diaphragm fastening edge 58" for fastening purposes. The annular shoulder 61" circumscribes the axial sound passage 49" in the transducer housing 41". FIG. 7 also shows the upper part 62" of the transducer associated with the lower part 41" of the transducer. The body associated with the lower part 41" of the transducer, the housing shell 43" described above, terminates cylindrically and continues into a cylindrical shoulder of the upper part 62" of the housing while maintaining small outer dimensions 48".

The compact hearing aid construction shown in FIGS. 1 to 4 is made possible by the space-saving construction principle of the transducer. The compact construction of the hearing aid results in a considerable reduction in weight and space and, in addition, allows the acoustic transducer to reproduce sound over a large frequency range and not only over a very narrow band-defined range as, for example, in hearing aids which were produced heretofore by means of individual preliminary otoplastic work.

The individual adjustability of the hearing aid by means of the movable ear tube and the compact constructional form due to the space-saving construction of the acoustic transducer enable the design of a hearing aid with previously unknown advantages.

It is noted that the arrangement of the microphone at a relatively great distance from the acoustic transducer which was described above is not compulsory. Rather, the microphone can also be arranged near the principal axis of the hearing aid. However, in this case a sufficient decoupling between the acoustic input of the microphone and the acoustic output of the acoustic transducer must be ensured by providing additional acoustic seals such as the sealing ring 18*b*.

The hearing aid according to the invention can be designed so as to be deliberately conspicuous externally so that, apart from its medical engineering function, it also serves as a fashion accessory. For this reason, also, the cover plate 70 is not flesh-colored like previous hearing aids, but can be provided with different designs, colors and motifs so that the hearing aid can serve as an ear ornament and hearing reinforcement simultaneously. This reduces the reluctance on the part of the user to wear such a device and/or also increases the appeal of hearing aid use for users in whom hearing impairment has already been established but who previously declined to have expensive otoplastic hearing aids prepared for reasons of cost.

Of course, it is possible to provide a wireless reception device in the hearing aid which responds to the input signals of a corresponding wireless transmitter and in which the loudness level can also be adjusted without the use of wires. This considerably simplifies the loudness adjustment for the user, since the user can now adjust the loudness relatively comfortably because the mechanically rotating adjusting member for adjusting loudness cannot be seen without a mirror.

While the foregoing description and drawings represent the preferred embodiments of the present invention, it will be obvious to those skilled in the art that various changes and modifications may be made therein without departing from the true spirit and scope of the present invention.

What is claimed is:

1. In a hearing aid having an electrodynamic transducer, the improvement comprising:

a housing, an ear tube, said ear tube having an interior portion for allowing sound waves generated by the electrodynamic acoustic transducer to be transmitted therethrough and being movably supported relative to said housing, said ear tube having a distal opening adapted for communicating with an auditory canal the distal opening having a first axis substantially perpendicular to a plane defined by the distal opening and said electrodynamic transducer having an axis of rotation relative to said housing, said ear tube being positioned so that said first axis intersects said axis of rotation at a predetermined angle and at a location proximal to the distal opening: and a loudness regulator, said loudness regulator comprising a base and a flap, said base providing a recess adapted to receive a battery for electrical connection and said flap being moveable relative to said base between open and locked states.

2. The hearing aid of claim 1 wherein said predetermined angle is approximately 45 degrees.

3. The hearing aid of claim 1 wherein said loudness regulator is rotatable relative to said housing.

* * * * *